US008039768B2

(12) United States Patent
Postmus

(10) Patent No.: US 8,039,768 B2
(45) Date of Patent: Oct. 18, 2011

(54) ELECTRICAL SWITCH WITH POSITIVE STATUS INDICATION

(75) Inventor: Albert Jozef Peter Postmus, Goor (NL)

(73) Assignee: Eaton Electric B.V., Hengelo (NL)

( * ) Notice: Subject to any disclaimer, the term of this patent is extended or adjusted under 35 U.S.C. 154(b) by 529 days.

(21) Appl. No.: 12/138,534

(22) Filed: Jun. 13, 2008

(65) Prior Publication Data

US 2008/0308393 A1 Dec. 18, 2008

(30) Foreign Application Priority Data

Jun. 14, 2007 (EP) ..... 07110300

(51) Int. Cl.
*H01H 9/20* (2006.01)

(52) U.S. Cl. ..... 200/43.11; 200/308; 200/401

(58) Field of Classification Search ..... 200/17 R, 200/18, 43.01–43.22, 329, 330, 334, 335, 200/400, 401, 564, 308
See application file for complete search history.

(56) References Cited

U.S. PATENT DOCUMENTS 6,566,618 B2 * 5/2003 Hamada et al. ..... 200/330

* cited by examiner

*Primary Examiner* — Renee Luebke
*Assistant Examiner* — Marina Fishman
(74) *Attorney, Agent, or Firm* — Eckert Seamans Cherin & Mellott, LLC; Kirk D. Houser, Esquire

(57) ABSTRACT

An electrical switch includes a rotary switch actuator device, and an actuator locking device. The actuator locking device inhibits the rotation of the rotary switch actuator device when the contacts of the switch are closed. Only when the operator tries to open the switch with an operating handle and the contacts do actually open, a lock release device will release the actuator locking device, and allow the operator to move the operator handle to the position corresponding to the open condition. When the contacts do not open, e.g., because they are welded, the actuator locking device will remain locked and the handle movement is blocked. This provides a robust and safe switch that never gives a false "OFF" indication.

12 Claims, 10 Drawing Sheets

ELECTRICAL SWITCH WITH POSITIVE STATUS INDICATION

This application claims priority from European Regional patent application No. 07110300.6, filed Jun. 14, 2007, which is hereby incorporated by reference herein.

FIELD OF THE INVENTION

The invention relates to a electrical switch comprising a rotary switch actuator device, operated by an operating handle, an actuator locking device, which substantially inhibits the rotary switch actuator device to change position when the actuator locking device is in its locked condition and a switch contact pair comprising a movable contact and a respective opposite contact for mutual contact, the movable contact being connected to the rotary switch actuator device.

BACKGROUND INFORMATION

Such a switch is known from US patent application US 2006/0278516. The known electrical switch device comprises a body upon which is mounted a hand lever that rotates about a main axis, cooperating with a transmission shaft able to control the opening or the closing of electrical contacts of the electrical switch device and elastic linking means between the hand lever and the transmission shaft. The device also comprises means for locking the rotation of the hand lever with respect to the body, used when an angular divergence between the hand lever and the transmission shaft exceeds a specified threshold. The purpose of the know patent application is to limit the damage to the hand lever and to the electrical device when an operator attempts to return the hand lever to its "OFF" position whilst the contacts are welded and to prevent the beginning of electrical arcing if the operator should succeed in unsticking the contacts when rotating the hand lever.

The known switch has the disadvantage that its function relies fully on the performance of the elastic linking means, which shall be stiff enough for joining together the rotation of the hand lever and the shaft support in normal operation, and at the same time flex sufficiently when a rotational torque is applied to the hand lever while the shaft support is immobilized due to a welding between the contacts. These essentially conflicting requirements can cause the locking mechanism to malfunction after repetitive use, with the effect that a dangerous situation can arise in which it is possible to rotate the hand level to an "OFF"-position while the contacts are still closed, i.e., actually in the "ON"-position. It is a further disadvantage of the known switch that it puts tight requirements on the strength of the locking device, its corresponding parts in the body of the switch (the teeth) and the protuberance of the hand lever. This limits the maximum force that the device can withstand when the operator tries with a lot of force to unstick the contacts by applying a large rotational torque on the hand lever. Moreover, the known switch does not guarantee that the position of the hand lever is always clearly indicating whether the switch is actually "ON" or "OFF", i.e., when the contacts are closed or open respectively.

SUMMARY OF THE INVENTION

The present invention aims to provide a robust switch that never gives a false "OFF" indication, also not when the contacts are welded, and has a long lifetime. The invention aims at providing a construction which can withstand large forces without damaging the switch and especially without the risk of damaging the contacts. The invention further aims at providing clear indications of the true electrical condition of the switch, i.e. whether the contacts are closed or open, and especially when the contacts are closed and a erroneous "ON"-indication would lead to serious danger.

Hereto the switch according to the present invention is characterised in that the switch also comprises a lock release device, acting on the actuator locking device, the movable contact is operated from the switch actuator device via an intermediate mechanical connection, the movable contact provides (mechanical) feedback to the lock release device, the actuator locking device is automatically locked when the switch is activated, i.e., turned to "ON", and the actuator locking device is released by the lock release device.

In one embodiment, the lock release device is mechanically connected to the movable contact, such that the lock release device inhibits release of the actuator locking device when the movable contact is in contact with the opposite contact. The mechanical connection assures that the condition of the lock release device is always a direct and true indication of the condition of the electrical contact.

In a further embodiment, the lock release device comprises a lock release spring, the lock release spring being charged when the switch is activated, and the lock release spring being uncharged when the movable contact is released from the opposite contact when the switch is deactivated, while the lock release spring stays charged when the movable contact is not released from the opposite contact due to an obstruction of any kind (such as welding). In case the contacts are opening, this spring causes the lock release device to release the actuator locking device. In case the contacts are not opening, the lock release device can not release the actuator locking device, as it is mechanically held in a fixed position corresponding to the "ON" condition of the electrical switch.

In a further embodiment, the switch further comprises a driver, which is mechanically fixed to the lock release device, and the driver mechanically brings the movable contact in contact with the opposite contact via one or more intermediate mechanical connects when the switch is activated. The driver thus serves as a mechanical interface to the movable contact.

Preferably, the lock release device makes a substantially linear movement. This allows to transfer a movement in one plane to a movement in a plane in another orientation, e.g., perpendicular to it, in a robust way allowing to withstand large forces. The movement of the switch actuator device and the lock release device can thus be in another orientation than the movement of the movable contact.

In a further embodiment, the rotary switch actuator device comprises a recess, the actuator locking device comprises a locking element, and the locking element is moved into the recess to lock the actuator locking device and thus substantially inhibits the rotary switch actuator device to rotate. This is an effective way of obstructing the rotation of the rotary switch actuator.

Preferably, the recess of the rotary switch actuator device is a half-circular recess, and the locking element of the actuator locking device comprises a shaft with a half-circular section, which is turned into the half-circular recess to lock the actuator locking device. The mechanical strength of such a rotary lock system is much better than that of a linear pin-in-hole lock, as these locking shafts can withstand large forces. It also provides a stiff construction. Moreover, such a the rotary lock system requires relatively little energy for releasing.

The shaft with the half-circular section preferably comprises a shaft spring element, which is charged when the half-circular section is turned out of the half-circular recess and which is uncharged when the half-circular section is turning into the half-circular recess. This assures that the shaft always returns to a well-defined position.

In an embodiment, the rotary switch actuator device comprises an actuator spring element which causes the rotary switch actuator device to return to a clear return position when the movable contact is not in contact with the opposite contact. The spring element prevents the rotary switch actuator to take an in-between position in which it is not clear whether the switch is "ON" or "OFF". The spring element also prevents the contacts themselves to take intermediate positions, which further contributes to the safety of the switch.

Moreover, the rotary switch actuator device preferably comprises a driving shaft connected mechanically to the operating handle and a switch shaft, with the driving shaft acting on the switch shaft, and wherein the action of the driving shaft on the switch shaft gives a direct mechanical action to the switch shaft when the handle is moved in the direction to activate the switch, whereas the action of the driving shaft on the switch shaft gives a mechanical action to the switch shaft only after the driving shaft has been rotated over a minimum angle due to a mechanical tolerance between the driving shaft and the switch shaft when the handle is moved in the direction to deactivate the switch. The direct action when turning "ON" the switch is required by the operators of such switches. The delayed action when turning "OFF" the switch has no negative side effect when the switch functions normally, i.e., when the contacts are fully separated. However, when the contacts can not be fully separated, it gives the operator an indication that the switch actuator itself is still in good order, but the electrical switch is (at least partly) obstructed and that the contacts can not be separated. Moreover, it allows the operator to exert some more force to try to separate the contacts than it would when the handle would be fully fixed in position. Also the delayed action allows the operator to interrupt a switching-off action and leave the switch turned "ON" and the contacts closed, when he recognizes that he was mistakenly switching off the device.

In a preferred embodiment, the driving shaft and the switch shaft comprise a cylindrical interface surface, and the mechanical tolerance comprises a recess in one facing surface of the driving shaft and the switch shaft and an extension on the other facing surface of the driving shaft and the switch shaft. This makes a robust construction which can handle significant forces.

The rotary switch actuator device is preferably equipped with a switch shaft spring between the driving shaft and the switch shaft, the spring causing the driving shaft to return to a clear return position when the handle is not operated. This gives the operator a clear and unambiguous indication of the actual condition of the electrical switch. The spring moment can be selected to optimally suit the application, e.g., in case the switch is mounted in a system with a lot of friction on the rotation of the driving shaft, the spring moment can be made large.

The operating handle can be mounted directly to the driving shaft, but it can also be mounted on an extension shaft, such that no direct access to the rotary switch actuator is needed. The operating handle can be essentially any type of handle bar or knob.

In another embodiment, the switch operates two contact pairs of fused switches, each of the contact pairs having a corresponding actuator locking device acting on the rotary switch actuator device, and each of the two contact pairs having a corresponding lock release device acting on the corresponding actuator locking device. The contacts are thus simultaneously driven, and contact separation on both sides of the fuse is required to be able to turn the handle to the "OFF" position.

BRIEF DESCRIPTION OF THE DRAWINGS

These and other aspects of the invention will be further elucidated and described in detail with reference to the drawings, in which corresponding reference symbols indicate corresponding parts.

DESCRIPTION OF THE PREFERRED EMBODIMENTS

Figure 1A:
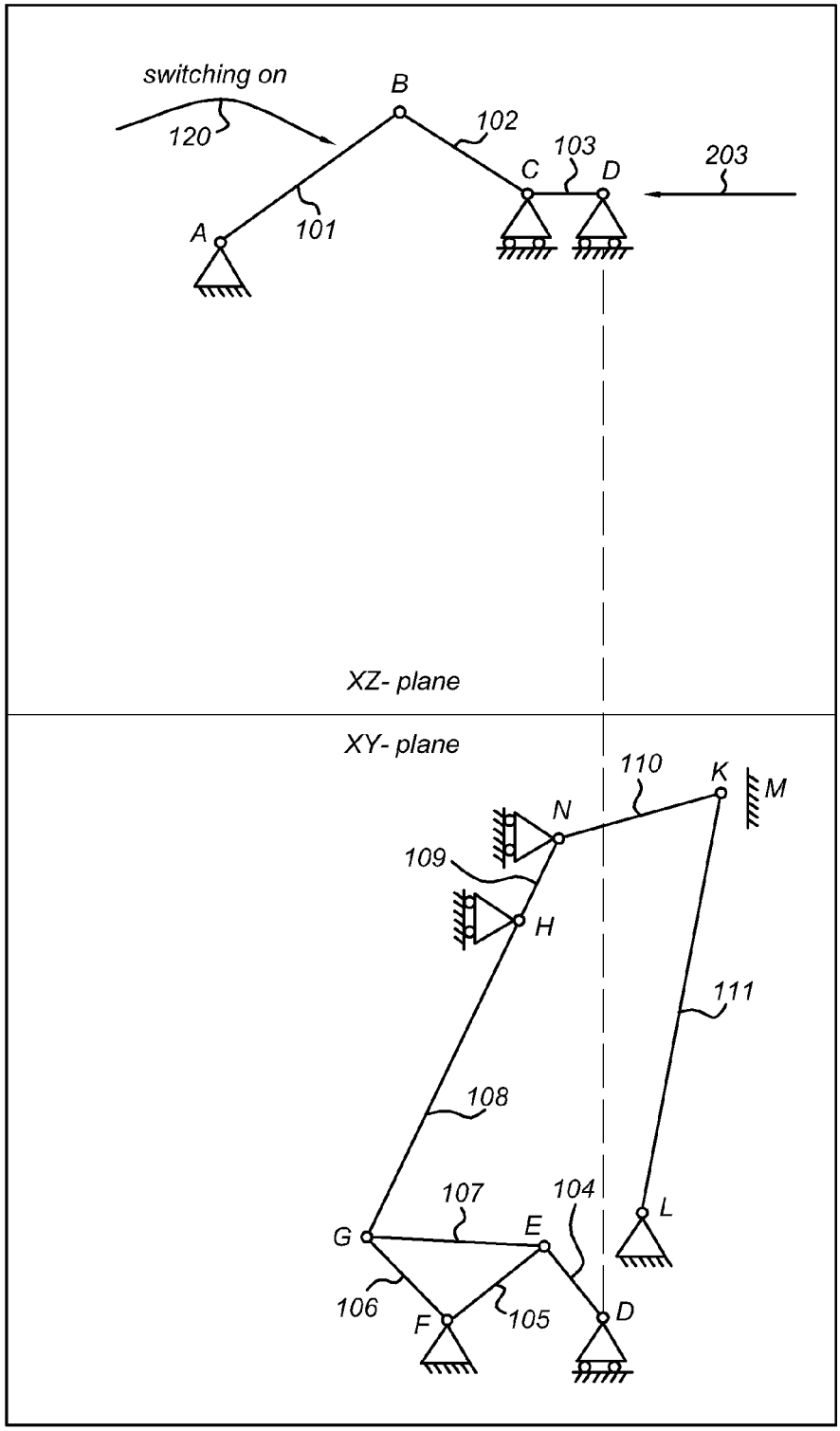
FIG. 1*a* is a schematic drawing of the operation mechanism of the switch according to a first embodiment of the present invention.
Figure 1B:
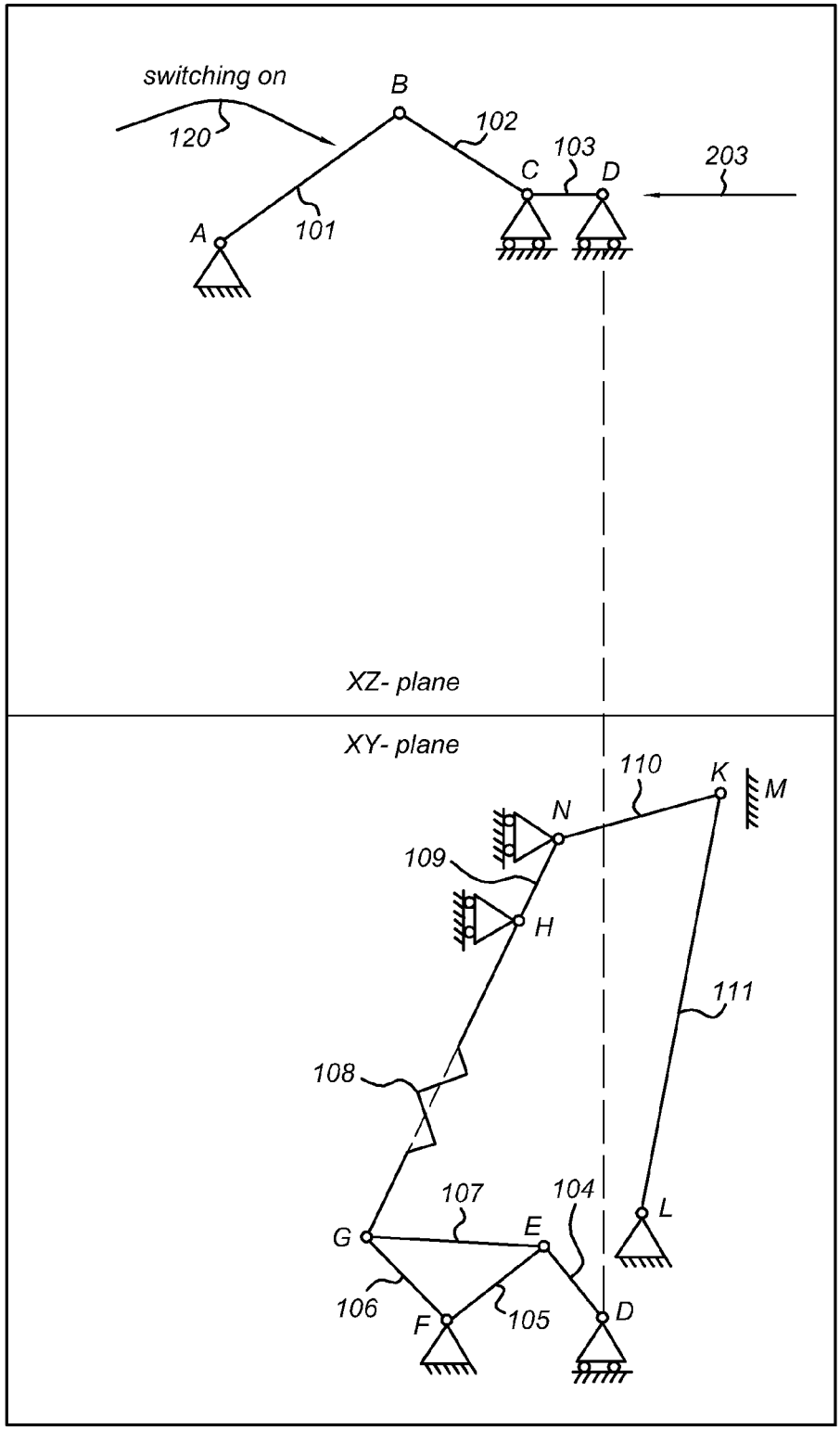
FIGS. 1*b*-1*d* shows exemplary embodiments of alternative connections from the rotary switch actuator to the movable contact.
Figure 1C:
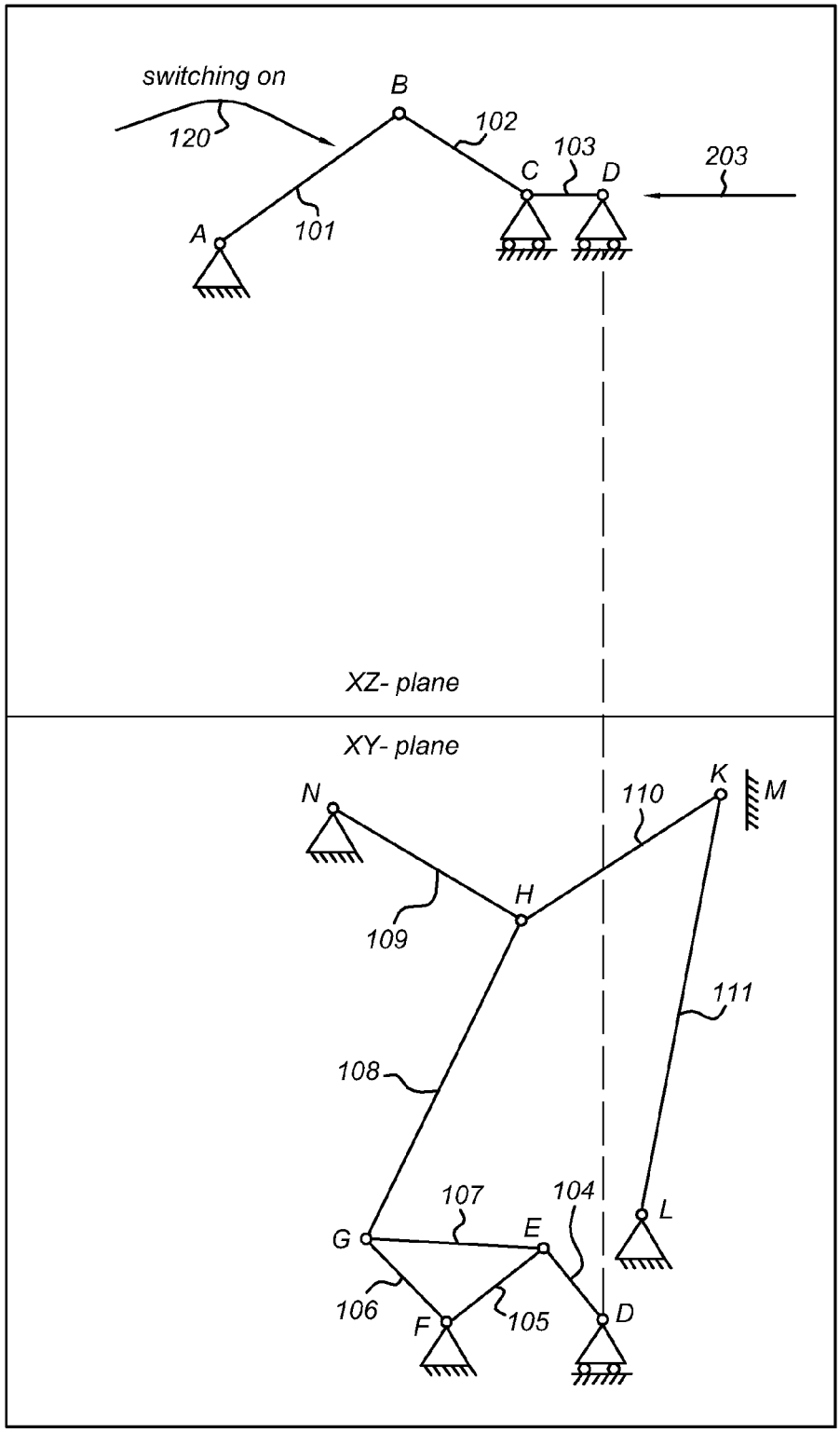
Figure 1D:
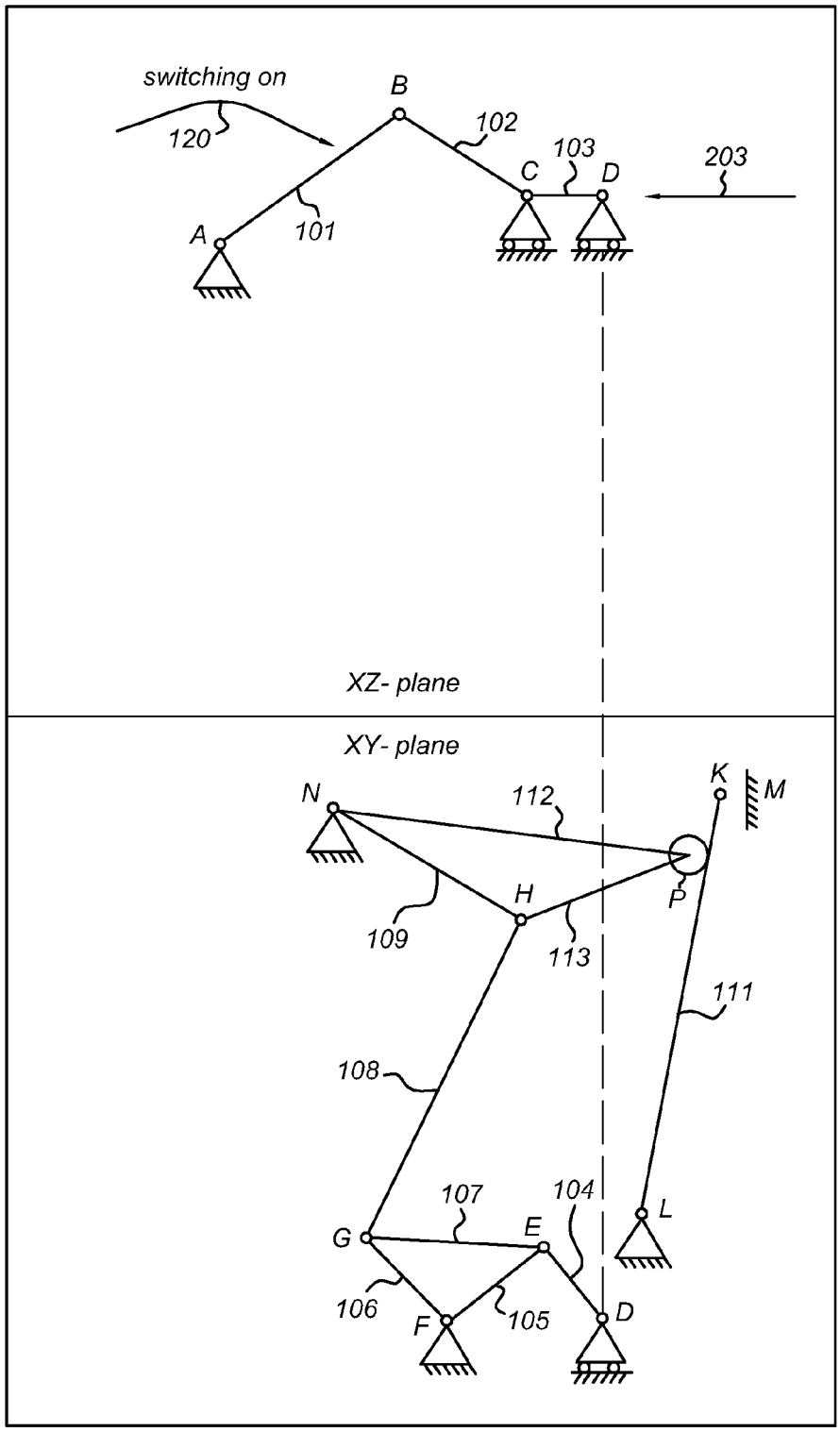

FIG. 1*a* is a schematic drawing of the operation mechanism of the switch. A lever 101 rotates around an axis A which is mounted in the switch housing. This lever 101 connects to a second lever 102 through a joint B, and the second lever 102 drives a slider 103. The slider 103 makes a linear movement along the line through a joint C and a pivot point D. The slider connects through the pivot point D to another lever 104, which again drivers another lever 105, which is pivoting in the housing around a shaft point F. In the drawing, the rotation of lever 105 is in a plane perpendicular to the plane in which lever 101 rotates, but these planes can also be in another orientation, e.g., in the same plane. Lever 105 drives a movable contact K via intermediate levers 106, 107, 109, 110, 111, connectors G, H, N, L, and a pretensioned spring 108, e.g., a leaf spring as drawn in FIG. 1*b*. The movable contact K can thus be moved in contact to or away from the fixed contact M. Although this example only shows the connection to a single contact pair K, M, it would also be possible to connect more poles to through the shaft point F. FIG. 1*c* shows another embodiment of the connection between pivot point D to the movable contact K, in which connector N is changed from a moving connector as in FIG. 1*a* to a fixed pivot point N, and connector H is changed into a joint between 108, 109, 110. FIG. 1*d* shows yet another embodiment of the connection between pivot point D to the movable contact K, in which H is not directly connected to K via lever 110, but via a sliding contact P. The sliding contact P is in contact with a slider 111 and which can move along slider 111. Slider 111 is connected between a fixed pivot pint L and the movable contact K. The sliding contact P moves in a guidance in slider 111. It pushes the slider to the right, thus moving the moving contact K towards the fixed contact M, when moving downward and pulls the slider to the left, thus moving the moving contact K away from fixed contact M, when moving upward.

Figure 2:
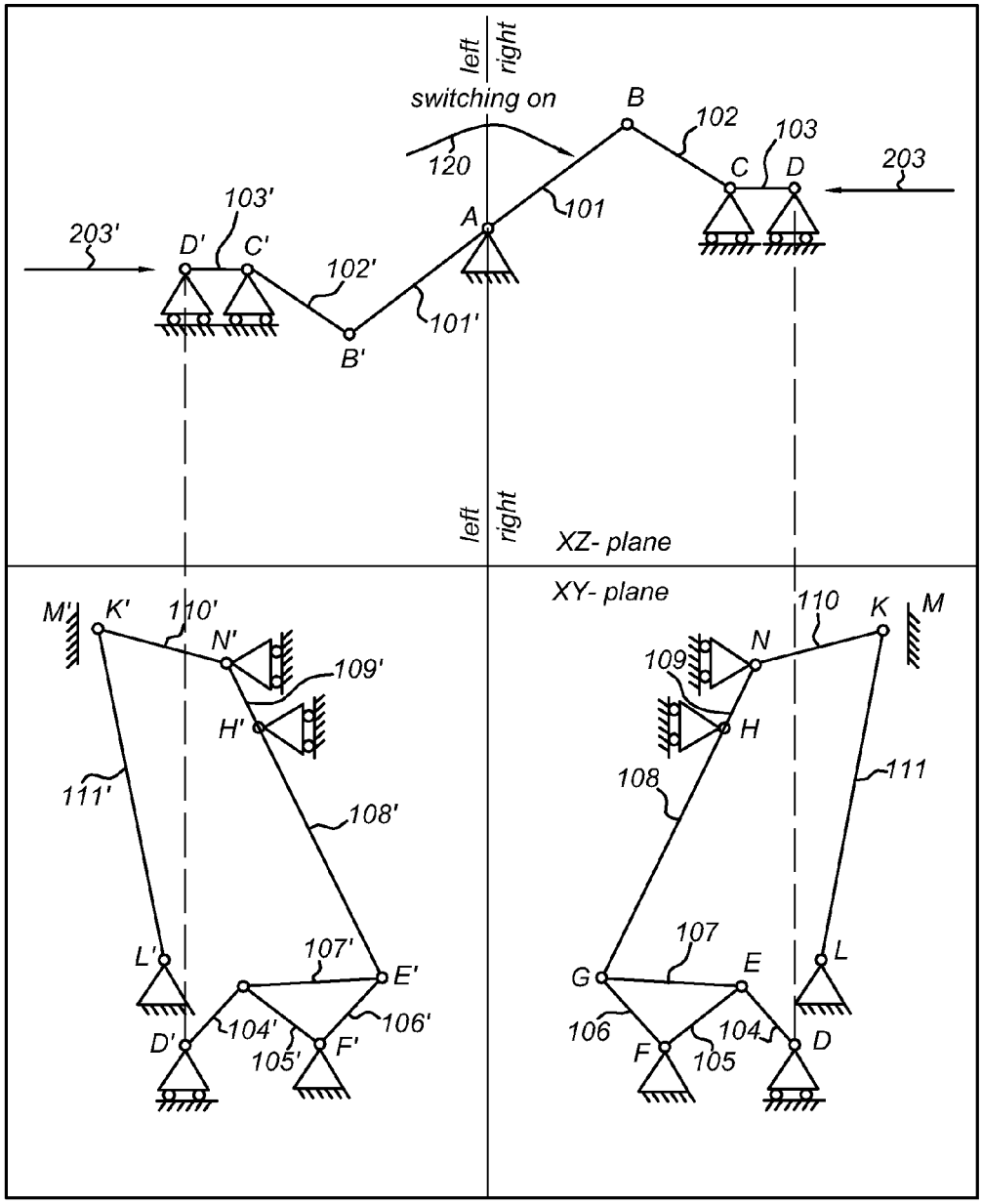
FIG. 2 is a schematic drawing of the operation mechanism of the switch according to a second embodiment of the present invention.

FIG. 2 is a schematic drawing of a double operation mechanism of the switch, i.e., where contact separation is demanded on two sides. This may be implemented when (dis-)connecting an element, such as a fuse, wherein the switching off is effected by a simultaneous contact separation on both sides of the element. Lever 101 is extended in diametrical direction with lever 101', connecting to a lever 102' through a joint B', and the lever 102' drivers a slider 103'. The slider 103' connects similarly to the slider 103 through a pivot point D' to another lever 105', pivoting in the housing around a shaft point F', and driving another movable contact K' via intermediate mechanical means 106', 107', 108', 109', 110', 110', connectors G', H', N', L' and a leaf spring 108', in contact to or away from a fixed contact M'.

Figure 3A:
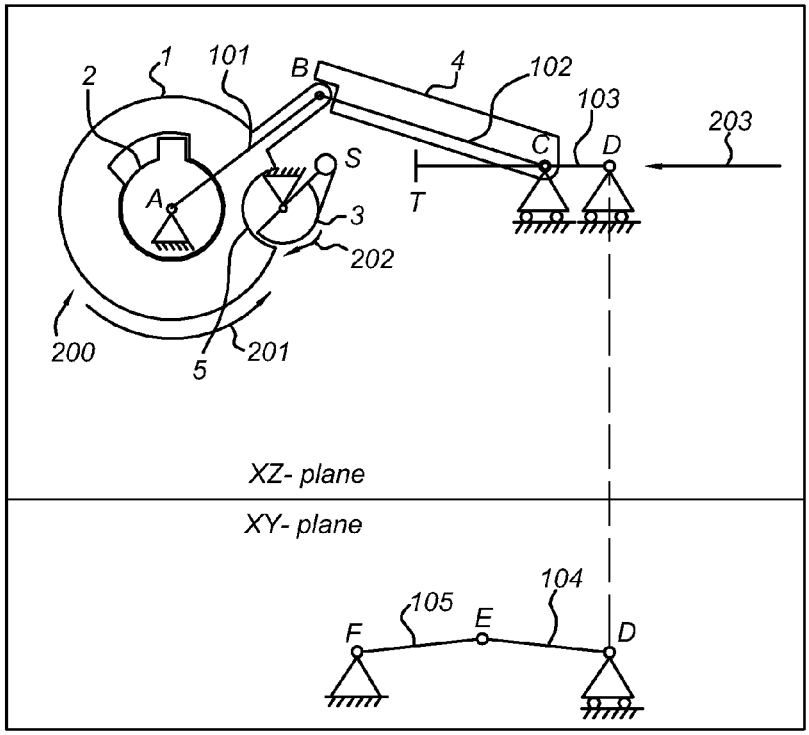
FIG. 3*a* shows a mechanical layout of a switch according to a first embodiment of the present invention when the switch is in the "ON" position.
Figure 3B:
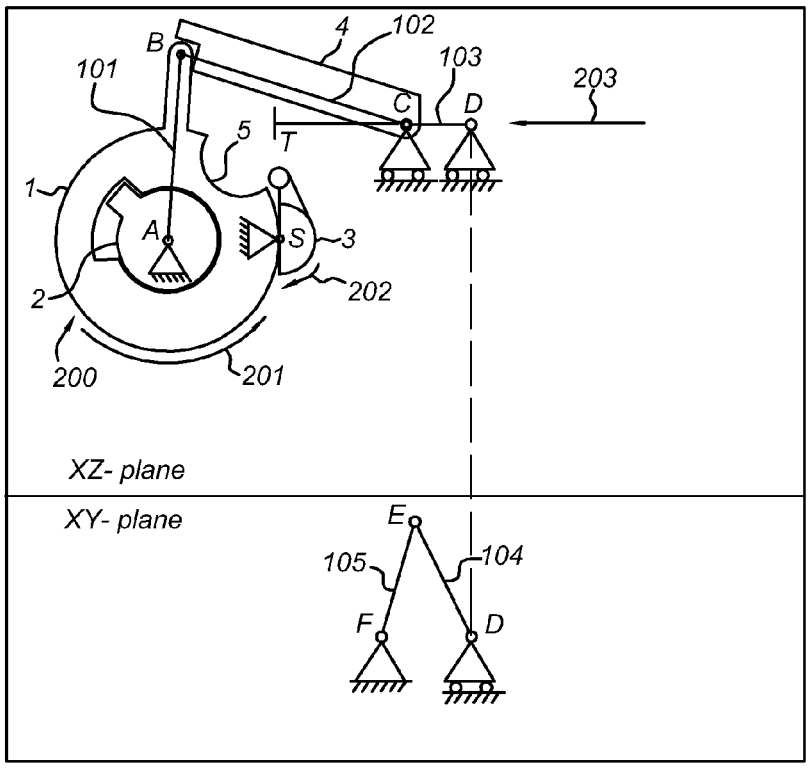
FIG. 3*b* shows a mechanical layout of a switch according to the first embodiment of the present invention when the switch is in the "OFF" position.

FIG. 3*a* and FIG. 3*b* show the mechanical layout of the switch, where the lever 101 is part of a rotary switch actuator 1,2 in the shape of a disc 1 rotating around axis A. The levers 101, 102, 103, 104 and 105, of which the function was described above, are also drawn again. The switch is equipped with an actuator locking mechanism, which locks the rotation of the actuator disc 1 when the contacts K,M are closed. The actuator locking mechanism has a receiving part in the actuator disc 1, in the form of a half-circular recess 5 in the actuator disc 1. The actuator locking mechanism further has an actuator locking device mounted in the housing, consisting of a rotating half-circular locking shaft 3, which can fit in the receiving half-circular recess 5 in the actuator disc, thus blocking the rotation of the actuator disc 1, as shown in FIG. 3*a*. When the actuator disc 1 is turned from an orientation corresponding to an open contact (FIG. 3*b*), the "ON" position, to an orientation corresponding to a closed contact (FIG. 3*a*), the "OFF" position, the half-circular locking shaft 3 is forced by a spring 202 to rotate into the half-circular recess 5. This way, the rotation of the actuator disc is automatically locked when the switch is activated, i.e., when the contacts have been closed. Any force on the actuator disc, e.g., by an operator trying to open the switch while it is locked, is thus led through the locking shafts 3,3' and the switch housing, and the rest of the switch, mechanism and contacts are free from experiencing this force. This way, the mechanism can withstand a big force.

The orientation of the actuator disc 1 between the "ON" position and the "OFF" position is preferable in the range of 30 to 40 degrees, in order to give a clear indication of its position independent from the type of operator handle being used.

The position of the actuator disc 1 is thus clearly defined when the contacts are closed, i.e., after the switching on movement has finished. When the switching on movement has not finished, the actuator disc is forced back to its "OFF" position by a spring 201 acting on the actuator disc 1, such that the actuator disc also has a clearly defined "OFF" position. Only when both contacts are open, the "OFF" position can be reached.

Figure 4:
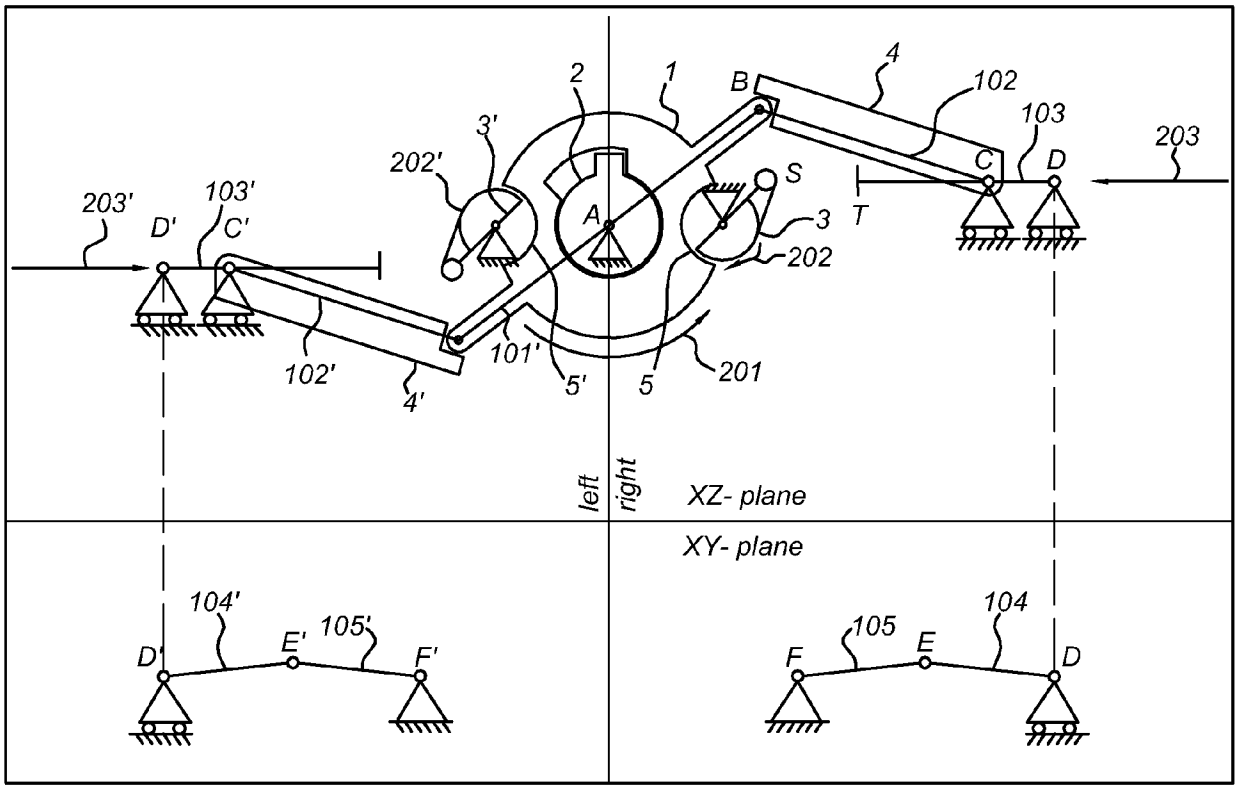
FIG. 4 shows a mechanical layout of a switch according to a second embodiment of the present invention.

FIG. 4 shows a double mechanism in which a first half-circular locking shaft 3 locks the actuator disc 1 with a first half-circular recess 5, and a second half-circular locking shaft 3' locks the actuator disc 1 with a second half-circular recess 5'.

Figure 5:
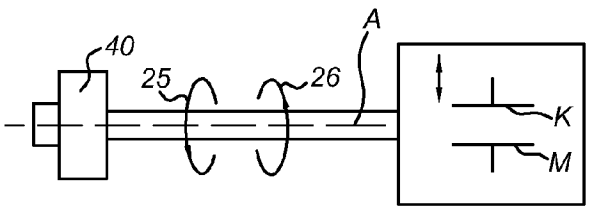
FIG. 5 shows a schematic drawing of a switch according to the invention.

FIG. 5 gives a schematic drawing of a switch. A handle 40 acts on the axis A, which drives the movable contact K in contact to or away from the fixed contact M. The handle 40 can rotate the axis A in a direction 25 or in an opposite direction 26. The handle 40 is rotated in the direction 25 when the operator wants to activate of the switch, i.e., to close the contacts M, K, by turning the handle to the "ON" position. The handle 40 is rotated in the direction 26 if the operator wants to deactivate the switch, i.e., to open the contacts, by turning the handle to the "OFF" position. The handle 40 may be mounted directly on the rotary switch actuator, or remotely on an extension shaft.

Figure 6:
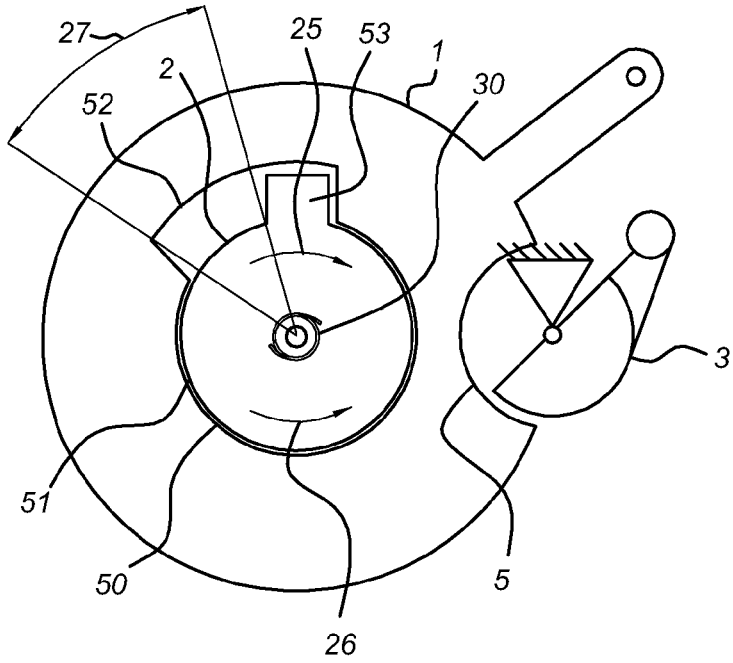
FIG. 6 shows again a mechanical layout of a rotary switch actuator according to a first embodiment of the present invention, and also shows the switch shaft and the driving shaft in detail.
Figure 7:
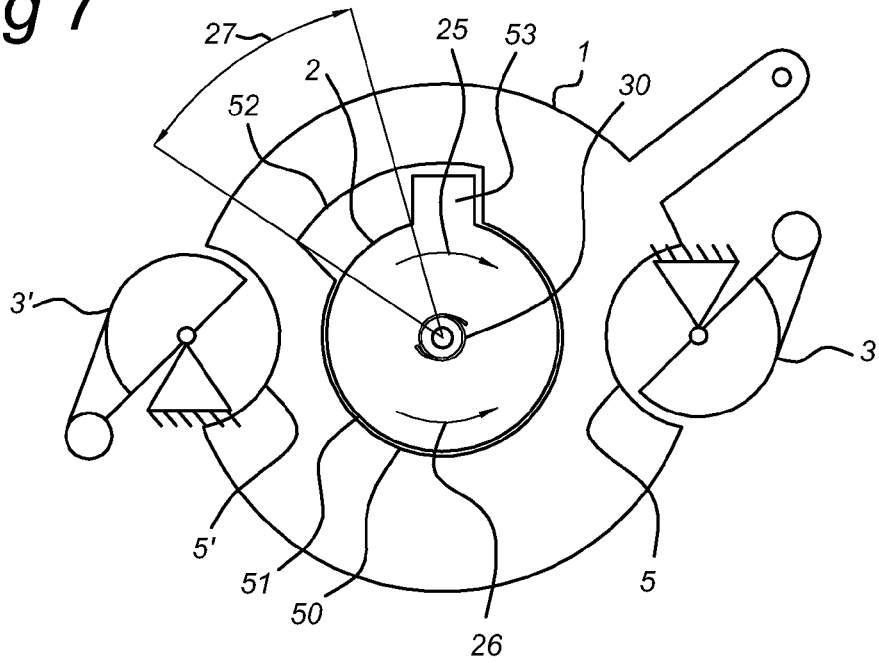
FIG. 7 shows again a mechanical layout of a rotary switch actuator according to a second embodiment of the present invention, and also shows the switch shaft and the driving shaft in detail.

FIG. 6 gives a detailed view of the actuator disc, and FIG. 7 gives a similar view for the double mechanism. The actuator disc 1 is driven by a driving shaft 2, which is connected mechanically to the operating handle. This driving shaft 2 acts directly on the switch shaft 1 when the handle is moved in the direction to activate the switch, i.e., in the clockwise direction 25 in the figures. However, the action of the driving shaft 2 on the switch shaft 1 gives a mechanical action to the switch shaft 1, only after the driving shaft 2 has been rotated over a minimum angle 27 in the counterclockwise direction 26 corresponding to a mechanical tolerance 27 between the driving shaft 2 and the switch shaft 1 when the handle is moved in the direction 26 to deactivate the switch. The mechanical tolerance is arranged by providing the inner cylindrical interface surface 50 of the switch shaft 1 with a recess 52, and the outer cylindrical interface surface 51 of the driving shaft with an extension 53. The width of the extension 53 is smaller than the width of the recess 52, such that the mechanical tolerance is achieved.

A spring 30 is provided between the switch shaft 1 and the driving shaft 2, keeping them in the position towards each other as shown in FIG. 5, as the spring provides a moment on the driving shaft 2 in the direction 25. As a result, the "ON" position of the driving shaft is clearly defined when the actuator disc is in the "ON" position, also without an external moment on the driving shaft, i.e., when the handle is not operated. When an external moment is applied in the "OFF" direction 26, the driving shaft 2 and the handle 40 can only be moved over a limited angle 27 when the actuator disc is in the locked condition. After releasing the handle, it will move back again in the "ON" position.

Figure 8:
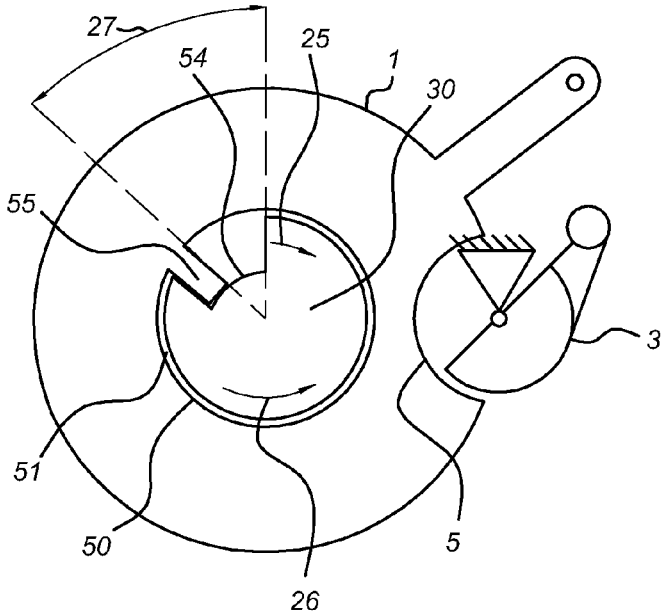
FIG. 8 shows again a mechanical layout of a rotary switch actuator according to an embodiment of the present invention, and also shows the switch shaft and the driving shaft in detail.

FIG. 8 shows an alternative construction of the cooperation of the actuator disc 1 and the driving shaft 2. In this construction, the mechanical tolerance is arranged by providing the inner cylindrical interface surface 50 of the switch shaft 1 with an extension 55, and the outer cylindrical interface surface 51 of the driving shaft 2 with an recess 54. The width of the extension 55 is smaller than the width of the recess 54, such that the mechanical tolerance is achieved.

Figure 9:
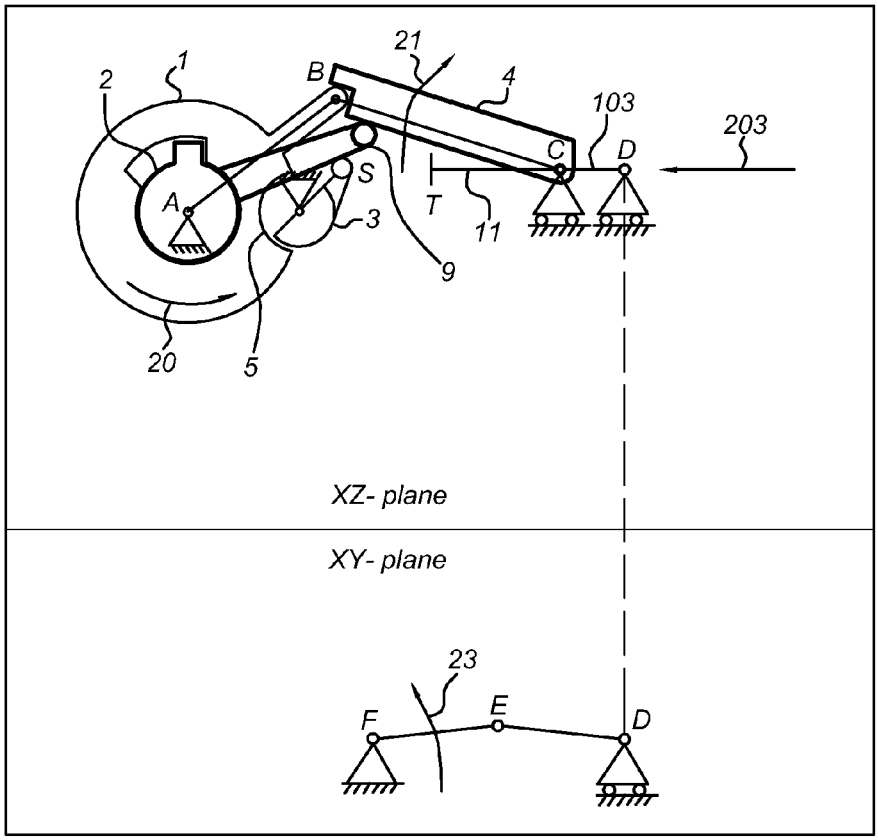
FIG. 9 shows again a mechanical layout of a switch according to a first embodiment of the present invention, indicating the action of the driving shaft at switching off.

FIG. 9 again shows the mechanical layout of the switch. To close the contacts, the operator will rotate the handle in the clockwise direction, and apart from activating the actuator locking mechanism as described above, it also acts via the lever 4 to the slider 103, at the same time charging (straining) a spring 203 acting on the slider 103. When the operator wants to open the switch again, he turns the handle on the counterclockwise direction and a projection 9 of the driving shaft 2 will force the lever 4 to rotate in the direction 21, leading to a detachment of lever 4 from the actuator disc 1. In the normal situation, the spring action on the slider 103 would move the slider back to its original position and thus also separate the contacts K,M via the mechanical construction. If however this mechanical movement is frustrated, in particular when the contacts are not fully separated, the slider 103 is kept in position.

The slider 103 is extended with a lock release driver 11. The lock release driver 11 acts on the locking shaft 3 when the spring of the slider 103 is uncharged. The lock release driver 11 then forces the locking shaft 3 to rotate out of the half-circular recess 5 in the actuator disc 1, thus releasing the actuator lock and allowing the actuator disc 1 to rotate back into the "OFF" direction 20 when the handle is operated to turn "OFF" the switch. When the spring is charged however, the lock release driver 11 will not release the lock, as it will not act on the locking shaft 3. The ability for mechanical movement of the slider 103 with its lock release driver 11 will thus determine whether the actuator lock can be released or not. Hence, when no full contact separation can be achieved, the slider is kept in position by the mechanical connection to the contact, and the lock release driver will not release the actuator lock. The actuator disc will thus stay in its "ON" position, indicating the true condition of the contact. When full contact separation is achieved however, the slider will be moved by the uncharging of its spring, and the lock release driver will release the actuator lock, thus allowing the actuator disc to rotate back into the "OFF" position, again indicating the true position of the contact.

Figure 10:
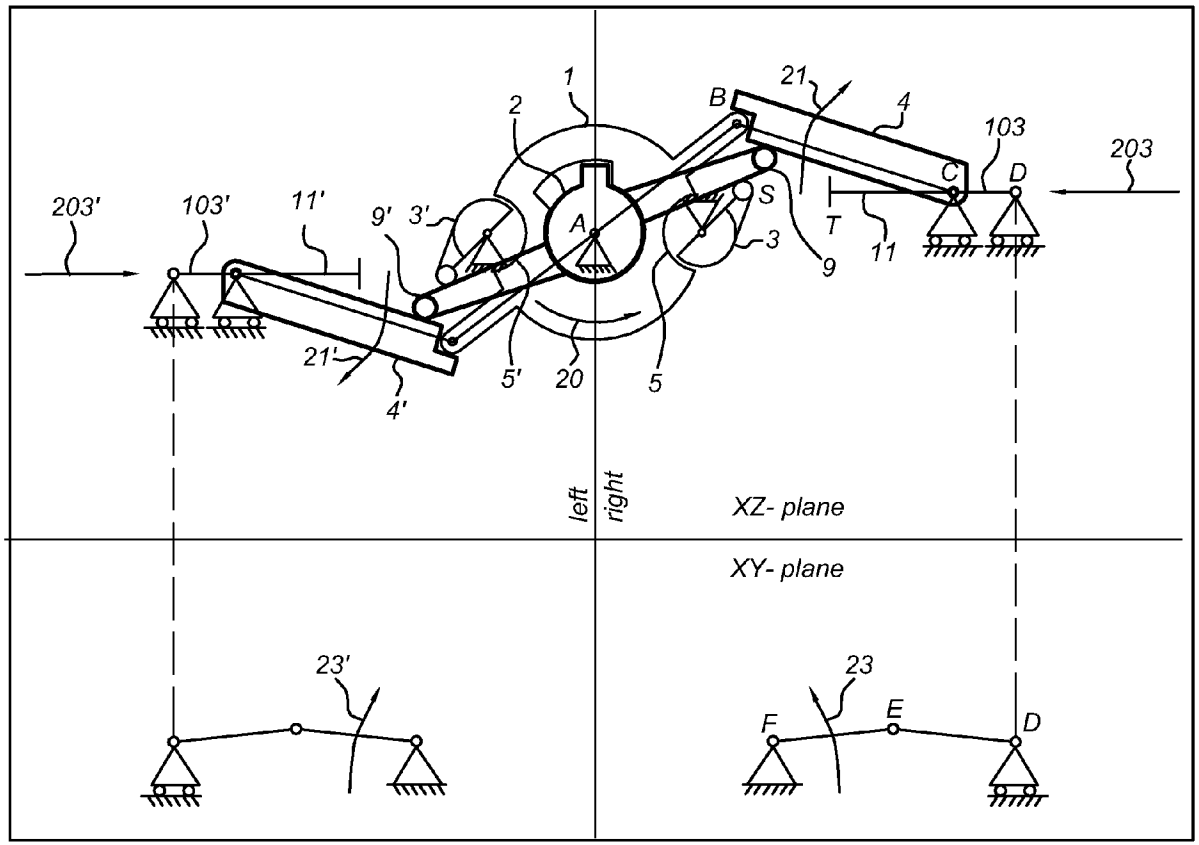
FIG. 10 shows again a mechanical layout of a switch according to a second embodiment of the present invention, indicating the action of the driving shaft at switching off.

FIG. 10 shows the double mechanism. In that case, it will be clear from the description above that the release of both actuator locking devices 3,5 and 3',5' is needed for allowing the actuator disc to move to an "OFF" position. It will thus only indicate an "OFF" situation when all contacts are fully separated.

It should be noted that the above-mentioned embodiments illustrate rather than limit the invention, and that those skilled in the art will be able to design many alternative embodiments without departing from the scope of the appended claims. E.g., the half-circular section 3 of the locking element can have rounded corners, or be another fraction of a circle-segment, without departing from the scope of the invention and the appended claims.

In the claims, any reference signs placed between parentheses shall not be construed as limiting the claim. The word "comprising" does not exclude the presence of elements other than those listed in a claim. The word "a" or "an" preceding an element does not exclude the presence of a plurality of such elements.

What is claimed is:

1. A switch comprising:

a rotary switch actuator device, operated from an operating handle, an actuator locking device, which substantially inhibits the rotary switch actuator device to change position when the actuator locking device is in its locked condition, a switch contact pair comprising a movable contact and a respective opposite contact for mutual contact, the movable contact being connected to the rotary switch actuator device, and a lock release device, acting on the actuator locking device, the movable contact is operated from the rotary switch actuator device via an intermediate mechanical connection, the movable contact provides mechanical feedback to the lock release device, the actuator locking device is automatically locked when the switch is activated, the actuator locking device is released by the lock release device, the rotary switch actuator device comprises a recess, the actuator locking device comprises a locking element, the locking element is moved into the recess to lock the actuator locking device and thus substantially inhibits the rotary switch actuator device to rotate, the recess of the rotary switch actuator device is a half-circular recess, and the locking element of the actuator locking device comprises a shaft with a half-circular section, the half-circular section of the actuator locking shaft is turned into the half-circular recess to lock the actuator locking device and thus substantially inhibits the rotary switch actuator device to rotate.

2. A switch according to claim 1, wherein the lock release device is mechanically connected to the movable contact.

3. A switch according to claim 2, wherein the lock release device comprises a lock release spring, the lock release spring being charged when the switch is activated, the lock release spring being uncharged when the movable contact is released from the opposite contact when the switch is deactivated, while the lock release spring stays charged when the movable contact is not released from the opposite contact.

4. A switch according to claim 1, wherein the switch further comprises a driver, the driver is mechanically fixed to the lock release device, and the driver mechanically brings the movable contact in contact with the opposite contact when the switch is activated.

5. A switch according to claim 1, wherein the lock release device makes a substantially linear movement.

6. A switch according to claim 1 , wherein the shaft with the half-circular section comprises a shaft spring element, the shaft spring element is charged when the half-circular section is turned out of the half-circular recess and the shaft spring element is uncharged when the half-circular section is turning into the half-circular recess.

7. A switch according to claim 1, wherein the rotary switch actuator device comprises an actuator spring element, which forces the rotary switch actuator device into a clear return position when the movable contact is not in contact with the opposite contact.

8. A switch according to claim 1, wherein the operating handle is mounted on an extension shaft.

9. A switch according to claim 1, comprising at least two contact pairs, each of the at least two contact pairs, having a corresponding actuator locking device acting on the rotary switch actuator device, and each of the at least two contact pairs, having a corresponding lock release device acting on the corresponding actuator locking device.

10. A switch comprising:

a rotary switch actuator device, operated from an operating handle, an actuator locking device, which substantially inhibits the rotary switch actuator device to change position when the actuator locking device is in its locked condition, a switch contact pair comprising a movable contact and a respective opposite contact for mutual contact, the movable contact being connected to the rotary switch actuator device, and a lock release device, acting on the actuator locking device, the movable contact is operated from the rotary switch actuator device via an intermediate mechanical connection, the movable contact provides mechanical feedback to the lock release device, the actuator locking device is automatically locked when the switch is activated.

the actuator locking device is released by the lock release device, wherein the rotary switch actuator device comprises:

a driving shaft connected mechanically to the operating handle, a switch shaft, the driving shaft acts on the switch shaft, wherein the action of the driving shaft on the switch shaft gives a direct mechanical action to the switch shaft when the handle is moved in the direction to activate the switch, whereas the action of the driving shaft on the switch shaft gives a mechanical action to the switch shaft, only after the driving shaft has been rotated over a minimum angle corresponding to a mechanical tolerance between the driving shaft and the switch shaft when the handle is moved in the direction to deactivate the switch.

11. A switch according to claim 10, wherein the driving shaft and the switch shaft comprise a cylindrical interface surface, and the mechanical tolerance comprises a recess in one facing surface of the driving shaft and the switch shaft and an extension on the other facing surface of the driving shaft and the switch shaft.

12. A switch according to claim 11, wherein the rotary switch actuator device comprises a switch shaft spring between the driving shaft and the switch shaft, which causes the driving shaft to return to a clear return position when the handle is not operated.

* * * * *